US010490070B2

(12) United States Patent
Toshack et al.

(10) Patent No.: US 10,490,070 B2
(45) Date of Patent: Nov. 26, 2019

(54) BUS LANE PRIORITIZATION

(71) Applicant: Siemens Industry, Inc., Alpharetta, GA (US)

(72) Inventors: Frederick Toshack, Toronto (CA); A. Nathan Edds, La Grange, KY (US)

(73) Assignee: SIEMENS MOBILITY, INC., New York, NY (US)

( * ) Notice: Subject to any disclaimer, the term of this patent is extended or adjusted under 35 U.S.C. 154(b) by 0 days.

(21) Appl. No.: 15/882,239

(22) Filed: Jan. 29, 2018

(65) Prior Publication Data

US 2019/0236942 A1 Aug. 1, 2019

(51) Int. Cl.
*G08G 1/07* (2006.01)
*G08G 1/042* (2006.01)

(52) U.S. Cl.
CPC ..... *G08G 1/07* (2013.01); *G08G 1/042* (2013.01)

(58) Field of Classification Search
CPC ..... G08G 1/07; G08G 1/042
See application file for complete search history.

(56) References Cited

U.S. PATENT DOCUMENTS 4,321,589 A * 3/1982 King ..... G08G 1/087 340/384.7
5,929,787 A * 7/1999 Mee ..... G08G 1/07 340/683
6,016,109 A * 1/2000 Yosida ..... G08G 1/042 340/905
6,064,319 A * 5/2000 Matta ..... G08G 1/07 340/902
9,630,635 B2 4/2017 Toshack
2009/0256721 A1* 10/2009 Glatfelter ..... G08G 1/01 340/907
2010/0309023 A1* 12/2010 Busch ..... G08G 1/07 340/917
2011/0109478 A1* 5/2011 Williamson ..... G08G 1/087 340/906

(Continued)

FOREIGN PATENT DOCUMENTS

CN 102509462 B 8/2013

OTHER PUBLICATIONS

"WiMag Vehicle Detection System", Siemens Mobility Traffic Solutions Sopers Lane, Poole, Dorset, BH17 7ER Tel:+44 (O) 1202 782000 Email: sales.stc@siemens.com siemens.co.uk/traffic © Siemens 2015. All rights reserved.

*Primary Examiner* — Munear T Akki

(57) ABSTRACT

A bus lane prioritization system and method uses an approach magnetometer to detect a bus or other vehicle in a bus lane approaching an intersection, and an island exit magnetometer to detect when the vehicle has cleared the intersection. When the vehicle is approaching the intersection, the system signals a traffic light controller to control at least one traffic light to allow the vehicle in the bus lane to traverse the intersection without delay or with minimal delay, thereby prioritizing the bus lane. An optional crossing gate may also be used to prevent traffic from a perpendicular roadway from entering the intersection. When the vehicle clears the intersection, the system informs the traffic light controller that it is no longer necessary to configure the at least one traffic light to prioritize the bus lane, and optionally controls the crossing gate in a manner synchronized to the at least one traffic light.

17 Claims, 2 Drawing Sheets

(56) References Cited

U.S. PATENT DOCUMENTS

| | | | | |
|---|---|---|---|---|
| 2012/0229303 | A1* | 9/2012 | Loffl | G08G 1/087 340/906 |
| 2016/0189552 | A1* | 6/2016 | Hilleary | G08G 7/02 246/125 |
| 2016/0358463 | A1* | 12/2016 | Cho | G08G 1/0145 |
| 2017/0148317 | A1* | 5/2017 | Diba | G08G 1/0175 |

* cited by examiner

BUS LANE PRIORITIZATION

FIELD

This disclosure is directed toward prioritization by traffic control systems of bus lane traffic.

BACKGROUND

Designated bus lanes are intended to keep buses moving along safely and on-schedule. These bus lanes are sometimes used solely by buses, but may also be used by emergency vehicles in some embodiments. The ability for the bus to remain on schedule, even when the bus lane is dedicated solely to buses, can be negatively impacted by traffic signals and blocked intersections that prevent buses from moving through intersections in a timely manner. A solution is needed to prioritize bus traffic by allowing them to automatically control traffic signals in a manner that allows buses to pass through intersections without delay. The solution preferably does not require the installation of additional equipment on the buses.

DETAILED DESCRIPTION

Figure 1:
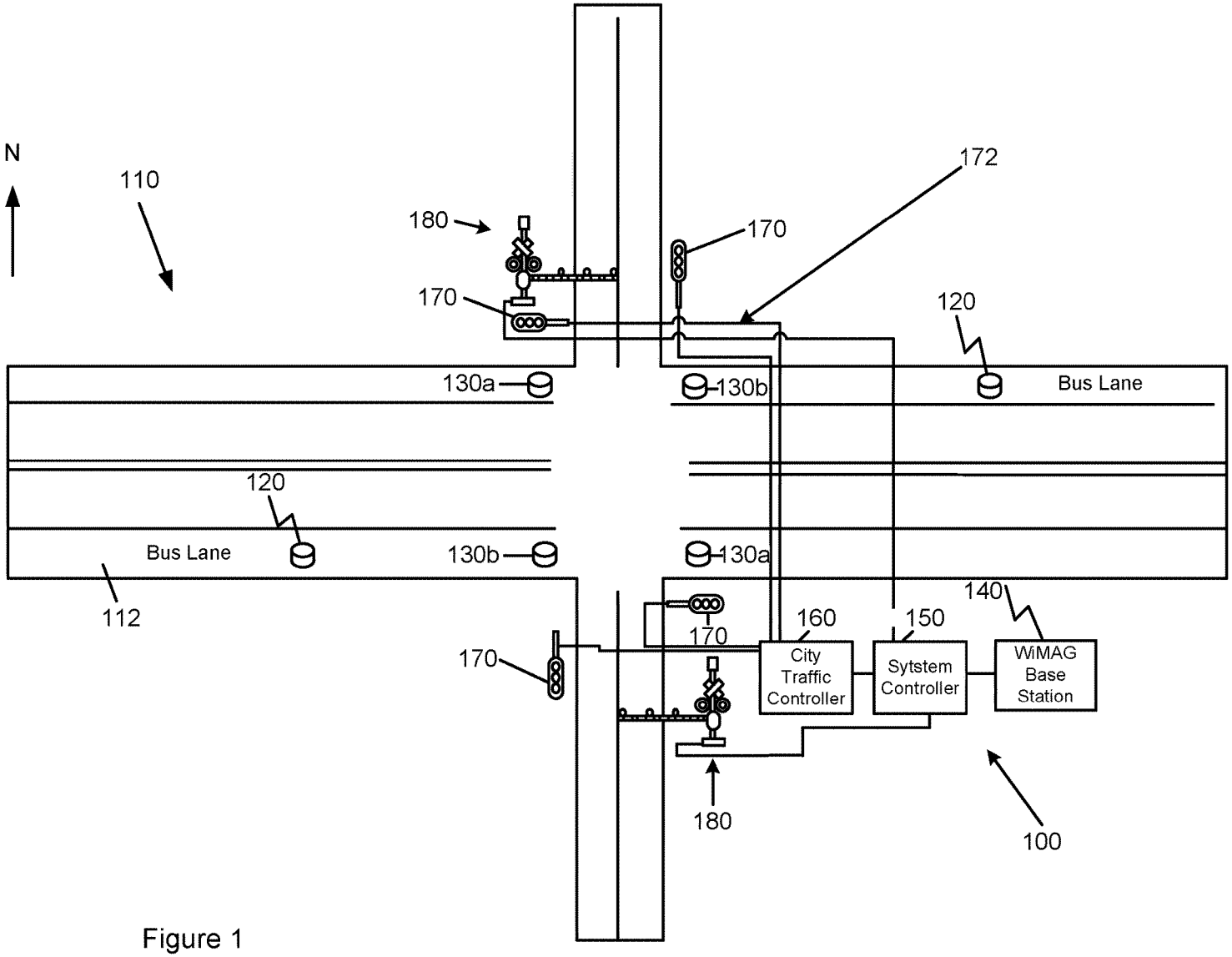
FIG. 1 is a plan diagram of a traffic prioritization system according to one embodiment.

A traffic prioritization system 100 as shown in FIG. 1 may include an approach magnetometer 120 and an island exit magnetometer 130*a* located in bus lane 112 on a road 110. The bus lane 112 may be a dedicated bus lane, with markings and signage, and possibly physical barriers such as curbs and guide rails, that keep motor vehicles other than buses out of the bus lane 112. Some embodiments may also include an entrance island magnetometer 130*b* as shown in FIG. 1. The term "island" is taken from the railroad industry and refers to the raised ground that is found at railroad grade crossings (i.e., the intersection of a railroad track with a roadway); the island magnetometers may also be referred to as intersection magnetometers). Where multiple bus lanes are present, such as the bus lanes provided for east and west travel as shown in FIG. 1, a set of magnetometers 120, 130 may be provided for each bus lane. The magnetometers 120, 130 may be configured to detect a change in the earth's ambient magnetic field caused by the presence of a metallic object such as a bus in the bus lane 112.

The magnetometers 120, 130 may communicate wirelessly with a wireless base station 140 as shown in FIG. 1, or may communicate via wired communication with a wired base station (not shown in FIG. 1). In some embodiments, the magnetometers 120 and 130 may be Wimag VD wireless magnetometers available from Siemens Corp. Such sensors are used for, among other things, detecting the presence of trains as discussed in U.S. Pat. No. 9,630,635, the contents of which are hereby incorporated by reference herein. The Wimag VD magnetometer is a battery powered magnetometer having a ten year battery life. The magnetometers 120, 130 may be configured to detect the presence of a large vehicle such as a bus and to transmit a detection signal along with a sensor ID that identifies the sensor the wireless magnetometer that detected the vehicle to the base station 140. The magnetometers 120, 130 may be configured to ignore disturbances in the magnetic field caused by smaller objects, such as bicycles and strollers. One particular advantage associated with the use of magnetometers rather than other types of sensors is that it allows the system 100 to operate without the need for any modification to buses or emergency vehicles that use the bus lane 112. This cost savings can be significant in jurisdictions with large bus and/or emergency vehicle fleets, and/or jurisdictions that allow private buses or buses from other jurisdictions to use the bus lane 112.

The base station 140 may receive detection signals from the magnetometers 120, 130 and may pass them to a system controller 150. The base station 140 and the controller 150 may be separate devices with separate processors, or may be a single physical device with a single processor (which may have one or more processing cores) that performs the functions of both. The controller 150 may process the detection signals from the magnetometers 120, 130 in a manner described below in connection with FIG. 2 in order to generate a control signal that may be output to a city traffic controller 160 to signify to the city traffic controller 160 that traffic lights 170 at the intersection 172 should be controlled so they allow a detected bus or other vehicle traveling in the bus lane 112 to pass through the intersection 172 without delay, or with reduced delay. The controller 150 (which may or may not be integrated with the base station 140) and the city traffic controller 160 may be separate devices or may be a single physical device that performs the functions of both devices (or all three devices if the base station 140 is also integrated). The controller 150 may also control optional crossing gates 180. Crossing gates 180 are positioned to physically restrict access to the intersection 172 by traffic in the roadway 114 perpendicular to the bus lane 112 when they are deployed (as used herein, "perpendicular" refers to any angle at which a roadway crosses the bus lane, regardless of whether the angle at which the cross occurs is right, obtuse, or acute). The crossing gates 180 may be of the type typically used to block automobile traffic from crossing train tracks at railway grade crossings in the U.S., but other types of crossing gates may also be used. The controller 150 may control the crossing gates to prevent traffic on the roadway 114 perpendicular to the bus lane 112 from impeding a bus in the bus lane 112 from crossing the intersection 172 in a manner described in more detail in connection with the description of FIG. 2 below.

Figure 2:
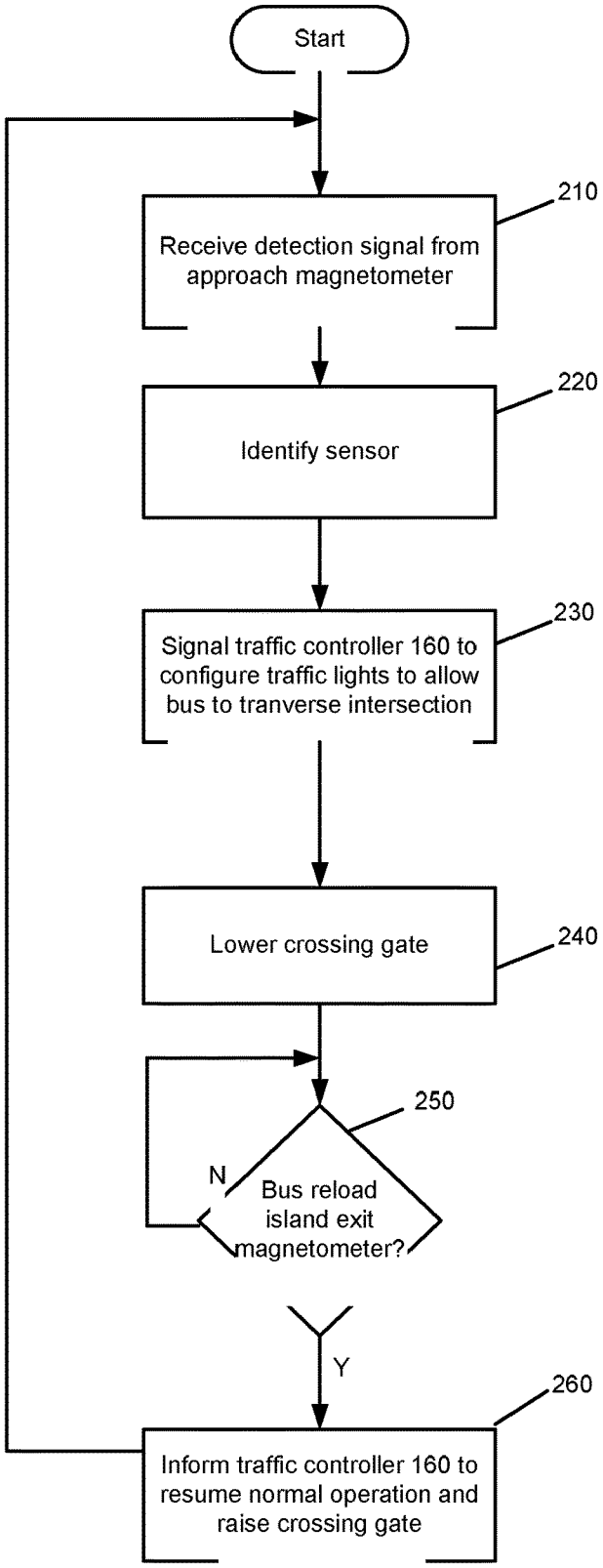
FIG. 2 is a flow chart illustrating operation of the traffic prioritization system of FIG. 1.

FIG. 2 is a flowchart 200 illustrating a method that may be performed by the system 100 in one embodiment. The method may begin when the controller 150 receives a detection signal from an approach magnetometer 120 via the base station 140 at step 210. The controller 150 may determine the identity of the approach magnetometer 120 at step 220. This step 220 is typically performed when multiple intersections and/or lanes are controlled by the controller 150, and may not be performed in embodiments in which the controller 150 is connected to only a single approach magnetometer 120. At step 230, the controller 150 sends a signal to the traffic controller 160 that instructs the traffic controller 160 to configure the traffic lights 170 at the intersection 172 to stop traffic on the roadway 114 perpendicular to the bus lane 112 from entering the intersection 172 and allow a bus in the bus lane 112 to traverse the intersection 172 without slowing down.

The timing of the signal from the controller 150 to the traffic controller 160 at step 230 depends on the distance separating the approach magnetometer 120 from the intersection 172. In some embodiments, the approach magnetometer 120 may be at a distance from the intersection 72 such that a bus traveling at an expected speed (which may be, e.g., the speed limit applicable to bus lane 112) will reach the intersection in a period of time equal to the period of time necessary to transition the traffic light 170 applicable to the perpendicular roadway 114 from green to yellow to red, plus a safety factor, so that the traffic light 170 applicable to the bus lane 112 can be set to green at the time the bus reaches the intersection 172. In this embodiment, the controller 150 may immediately send the signal to the traffic controller 160, which may be configured to immediately start the transition of the traffic lights to a configuration that will allow a bus in the bus lane 112 to traverse the intersection 172 without slowing down. In other embodiments, the timing may be different. For example, rather than including a single approach magnetometer 120 in the bus lane 112, two or more approach magnetometers 120 may be provided at a further distance from the intersection 172, and the controller 150 may be configured to determine the speed at which the bus is approaching the intersection 172 as discussed in the aforementioned U.S. Pat. No. 9,630,635 and may send the signal to the traffic controller 170 at a time depending on the determined speed. Still other arrangements are possible as will be recognized and understood by those of skill in the art.

As discussed above, some embodiments may include crossing gates 180. In these embodiments, the controller 150 may generate a signal at step 240 that causes the crossing gates 180 to lower, thereby restricting traffic in the roadway 114 perpendicular to the bus lane 112 from entering the intersection 172 Unlike the situation with a railroad grade crossing, lowering the crossing gate 180 is not critical because a bus can stop at a much shorter distance than can a train.

Following either step 230 (if no crossing gate 180 is present), or step 240 (if a crossing gate 180 is present), the controller 150 may determine at step 250 whether the bus has reached the exit island magnetometer 130*a*. The island magnetometer 130*a* may be positioned at a distance past the intersection such that it is certain that the rear end of the bus or emergency vehicle has passed the intersection if the bus or emergency vehicle has been detected by the island magnetometer 130*a*. If the bus has not yet passed the exit island magnetometer 130*a* at step 250, step 250 is repeated. If the bus has passed the exit island magnetometer 130*a* at step 260, the controller may send at step 260 a signal to the traffic controller 160 that informs the traffic controller 160 that it is no longer necessary to keep the traffic lights 170 in a configuration that allows a bus in the bus lane 112 to traverse the intersection. As will be understood by those of skill in the art, the traffic controller 160 may simply leave the traffic lights 170 in their current state after receipt of such a signal until such time as the next scheduled transition and resume normal operation at that time. If grade crossing gates 180 are present, the controller 150 may raise the crossing gates 180 in conjunction with a transition of the traffic lights 170 that allows traffic from the perpendicular roadway 114 to enter the intersection 172 (in such embodiments, the traffic controller 160 may be configured to provide the controller 150 with traffic light configuration information to facilitate such functionality; alternatively, an optical sensor included in the controller 150 may be used to determine the configuration of at least one traffic light 170 to facilitate such functionality). After completion of step 2600, step 210 is repeated.

In embodiment in which an entry island magnetometer 130 is employed, the island magnetometer may be used, along with approach magnetometer 120 and island exit magnetometer 130*a*, to confirm the direction of travel of the bus or emergency vehicle. In still other embodiments, detection of the bus by the exit island magnetometer 130*a* may be used to start a timer with a length of time, for example, of 15 minutes. If the bus or emergency vehicle has not passed the exit island magnetometer 130*a* (i.e., if the exit island magnetometer is still detecting the presence of the bus or emergency vehicle) at the expiration of the timer, a fault may be declared and various actions, e.g., any gate 180 may be lowered) may be taken in response thereto.

Is some embodiments, a visual indicator may be included. The visual indicator may take the form of an electronic sign, similar in size to a cross walk indicator found in many U.S. cities, oriented toward the operator of a vehicle in the bus lane 112. The electronic sign may be controlled by the system controller 150 or the city traffic controller 160. The electronic sign may display text or a graphic to indicate a status of traffic in the intersection 172. In one embodiment, the graphic may constitute a bar that is positioned vertically when the traffic lights 170 and any crossing gate 180 at the intersection 172 are configured for passage of the vehicle in the bus lane through the intersection, that is positioned at a forty five degree angle when the traffic lights 170 and any crossing gate 180 are in transition, and that is positioned horizontally when the traffic lights 170 and any crossing gate 180 at the intersection 172 are configured for an opposing flow of traffic, indicating that it is not safe for vehicles in the bus lane 112 to proceed through the intersection. In other embodiments, the status of the graphic may be based in whole or in part (along with the status of the traffic lights 172 and any crossing gate 180) on sensors (which may be Wimag sensors or other types of sensors) that sense the presence of vehicles in the intersection 172. Other graphics and/or color may be used in other embodiments.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A system for prioritizing bus lane traffic comprising:

an approach magnetometer positioned in a bus lane at a first distance in front of an entrance to an intersection, the first distance being sufficient to provide an amount of time prior to arrival at the intersection of a vehicle traveling at an expected rate of speed;

an exit island magnetometer positioned in the bus lane near an exit of the intersection;

a base station configured for communication with the approach magnetometer and the exit island magnetometer;

a crossing gate connected to the system controller and positioned to restrict traffic on a roadway perpendicular to the bus lane from entering the intersection;

a system controller connected to the base station and connectable to a traffic signal controller;

wherein the system controller is configured to determine a presence of the vehicle in the bus lane based on a signal sent from the approach magnetometer, wherein the signal sent from the approach magnetometer is created by a presence of a metallic field caused by a metallic part of the vehicle, wherein the approach magnetometer is configured to ignore the magnetic field created by metallic part of small vehicle including bikes and strollers and not to send a signal, and lowering the crossing gate to prevent traffic from impeding the vehicle in the bus lane from crossing the intersection;

in response to determining the presence of the vehicle based on the signal from the approach magnetometer, send a first signal to the traffic signal controller to cause the traffic signal controller to set at least one first traffic signal to a state that allows the vehicle to traverse the intersection; determine that the vehicle has cleared the intersection based on a signal from the exit island magnetometer; and in response to determining that the vehicle has cleared the intersection, send a second signal to the traffic controller to inform the traffic signal controller that it no longer needs to set the at least one first traffic signal to a state that allows the vehicle to pass through the intersection.

2. The system of claim 1, wherein the approach magnetometer and the exit island magnetometer are in wireless communication with the base station.

3. The system of claim 1, wherein the bus lane is a dedicated bus lane.

4. The system of claim 1, further comprising an entrance island magnetometer.

5. The system of claim 1, wherein the system controller and the traffic signal controller are implemented in a single physical device.

6. The system of claim 5, wherein the base station is also implemented in the single physical device.

7. The system of claim 1, wherein the traffic controller sets at least one second traffic signal to a state that disallows vehicles traveling on a roadway perpendicular to the bus lane from entering the intersection prior to setting the at least one first traffic signal to a state that allows the vehicle to traverse the intersection.

8. The system of claim 1, further comprising an electronic sign positioned for viewing by an operator of the vehicle in the bus lane and configured to display a status of traffic in the intersection.

9. A method for prioritizing bus lane traffic, the method comprising: determining at a system controller that a vehicle in a bus lane is approaching an intersection based on a signal sent from an approach magnetometer;

connecting a crossing gate to the system controller and positioned to restrict traffic on a roadway perpendicular to the bus lane from entering the intersection;

wherein the signal sent from the approach magnetometer is created by a presence of metallic field caused by a metallic part of the vehicle, wherein the approach magnetometer is configured to ignore the magnetic field created by metallic part of small vehicle including bikes and strollers and not to send a signal, and lowering the crossing gate to prevent traffic from impeding the vehicle in the bus lane from crossing the intersection;

in response to determining that the vehicle is approaching the intersection, sending a first signal from the system controller to a traffic signal controller to cause the traffic signal controller to set at least one traffic signal to a state that allows the vehicle to traverse the intersection until a further notice is received;

determining that the vehicle has cleared the intersection based on a signal from an exit island magnetometer; and in response to determining that the vehicle has cleared the intersection, sending a second signal from the system controller to the traffic controller to inform the traffic signal controller that it no longer needs to set the at least one first traffic signal to a state that allows the vehicle to pass through the intersection.

10. The method of claim 9, wherein the approach magnetometer and the exit island magnetometer communicate wirelessly with the base station.

11. The method of claim 9, wherein the bus lane is a dedicated bus lane.

12. The method of claim 9, further comprising lowering, by the system controller, a crossing gate connected to the system controller and positioned to restrict traffic on a roadway perpendicular to the bus lane from entering the intersection to prevent traffic from impeding a vehicle in the bus lane from crossing the intersection.

13. The method of claim 9, further comprising setting, by the traffic controller, at least one second traffic signal to a state that disallows vehicles traveling on a roadway perpendicular to the bus lane from entering the intersection prior to setting the at least one first traffic signal to a state that allows the vehicle to traverse the intersection.

14. The method of claim 9, further comprising setting a timer in response to detecting the vehicle by the exit island magnetometer and declaring a fault if the vehicle does not pass the exit island magnetometer prior to expiration of the timer.

15. The method of claim 9, further comprising displaying a status of traffic in the intersection to an operator of the vehicle in the bus lane.

16. The system of claim 1, wherein the determining the presence is without a modification to the vehicle.

17. The method of claim 9, wherein the presence of the vehicle is determined without a modification to the vehicle.

* * * * *